United States Patent [19]

Ishikawa et al.

[11] Patent Number: 4,765,295

[45] Date of Patent: Aug. 23, 1988

[54] THROTTLE VALVE CONTROLLER FOR INTERNAL COMBUSTION ENGINE

[75] Inventors: Yoshikazu Ishikawa; Kouji Yamaguchi; Takeo Suzuta, all of Wako, Japan

[73] Assignee: Honda Giken Kogyo Kabushiki Kaisha, Tokyo, Japan

[21] Appl. No.: 58,836

[22] Filed: Jun. 5, 1987

[30] Foreign Application Priority Data

Jun. 6, 1986 [JP] Japan ..... 61-131554

[51] Int. Cl.[4] ..... F02D 11/10

[52] U.S. Cl. ..... 123/399; 123/361

[58] Field of Search ..... 123/399, 361, 340

[56] References Cited

U.S. PATENT DOCUMENTS 4,453,516 6/1984 Filsinger ..... 123/399 X
4,691,676 9/1987 Kiluchi ..... 123/399
4,691,677 9/1987 Hotate et al. ..... 123/399

FOREIGN PATENT DOCUMENTS 2154763 9/1985 United Kingdom ..... 123/399

*Primary Examiner*—Tony M. Argenbright
*Assistant Examiner*—Eric R. Carlberg
*Attorney, Agent, or Firm*—Birch, Stewart, Kolasch & Birch

[57] ABSTRACT

An engine throttle valve control apparatus whereby a reference throttle valve degree of the opening is established in accordance with the accelerator pedal actuation position and a reference opening degree characteristic. A boundary throttle valve degree of the opening is established in accordance with the accelerator pedal actuation position and at least one upper limit opening degree characteristic and a lower limit opening degree characteristic. A target degree of the throttle opening is computed from the relationship between the reference degree of the opening and a boundary degree of the opening, in conjunction with the contents of a characteristic command which can be freely selected. Thereby throttle valve is driven to reduce the deviation between the actual degree of the opening and the target degree of the opening.

4 Claims, 4 Drawing Sheets

THROTTLE VALVE CONTROLLER FOR INTERNAL COMBUSTION ENGINE

BACKGROUND OF THE INVENTION

1. Field of Technology

The present invention relates to a throttle valve control apparatus for an internal combustion engine, whereby a degree of the throttle valve opening is controlled in accordance with the accelerator pedal actuation.

2. Background Technology

A throttle valve control apparatus is known in the prior art, whereby the actuation position of an accelerator pedal is detected and a throttle valve is driven in accordance with the relationship between the detected actuation position of the accelerator pedal and a predetermined characteristic of the degree of the throttle valve opening. Furthermore, a throttle valve control apparatus is known in the prior art (Japanese Patent Laid-open No. 59-74341) whereby a plurality of different throttle valve opening degree characteristics are stored in a memory as a data map. When one characteristic from among this plurality of opening degree characteristics is selected (by operation of a switch, for example), the throttle valve is driven in accordance with the difference between the accelerator pedal actuation position and the selected throttle valve opening degree characteristic.

With such a prior art throttle valve control apparatus, an appropriate opening degree characteristic can be selected in accordance with the current operating status of the engine, and hence an improved engine performance can be attained. However, since a substantial number of throttle valve opening degree characteristics are necessary in order to cover various different engine operating conditions, a comparatively large amount of memory capacity is required to store the necessary data. This leads to problems of increased manufacturing cost, in spite of recent reductions in memory prices. On the other hand, if only a small number of throttle valve opening degree characteristics are stored in the memory, then the system cannot respond to slight differences between the driving operations of a variety of drivers.

SUMMARY OF THE INVENTION

It is an objective of the present invention to provide a throttle valve control apparatus which can respond to slight differences between the driving operations of different drivers, by employing a substantial number of throttle valve opening degree characteristics, without utilizing a correspondingly large amount of memory capacity for storing such characteristics.

A throttle valve control apparatus according to the present invention functions to establish a reference throttle valve degree of opening. This reference is determined by the relationship between the accelerator pedal actuation position and a reference opening degree characteristic, and a boundary throttle valve degree of opening which is determined by the relationship between the accelerator pedal actuation position and at least one upper limit opening degree characteristic and a lower limit opening degree characteristic, .A a target degree of opening is computed from the relationship between the reference degree of opening which has been set and the boundary degree of opening, in conjunction with the contents of a characteristic command.

The the throttle valve is driven in a direction to reduce a deviation between the actual degree of opening of the throttle valve (detected by the throttle valve opening degree detection means) and the target degree of the throttle valve opening.

More specifically, a throttle control apparatus according to the present invention comprises accelerator actuation detection means for producing an output in accordance with an actuation position of an accelerator pedal, setting means for setting a target degree of the opening of the throttle valve in accordance with the actuation position of the accelerator pedal detected by the accelerator actuation detection means, throttle valve opening degree detection means for producing an output in accordance with an actual degree of the opening of the throttle valve, drive means for driving the throttle valve in a direction to reduce the amount of deviation between the actual degree of the opening of the throttle valve as detected by the throttle valve opening degree detection means and the target degree of the opening, and command means for issuing a characteristic command to specify a requisite target opening degree characteristic.

Wherein the setting means functions to set a reference degree of the opening of the throttle valve in accordance with the actuation position of the accelerator pedal by utilizing a reference opening degree characteristic and to set a boundary degree of the opening of the throttle valve in accordance with the actuation position of the accelerator pedal by utilizing at least one upper limit opening degree characteristic and a lower limit opening degree characteristic of the throttle valve. Thereby the target degree of the opening is computed from a relationship between the reference degree of the opening and the boundary degree of the opening which have thus been respectively set, in conjunction with the contents of the characteristic command.

DETAILED DESCRIPTION OF THE PREFERRED EMBODIMENTS

Figure 1:
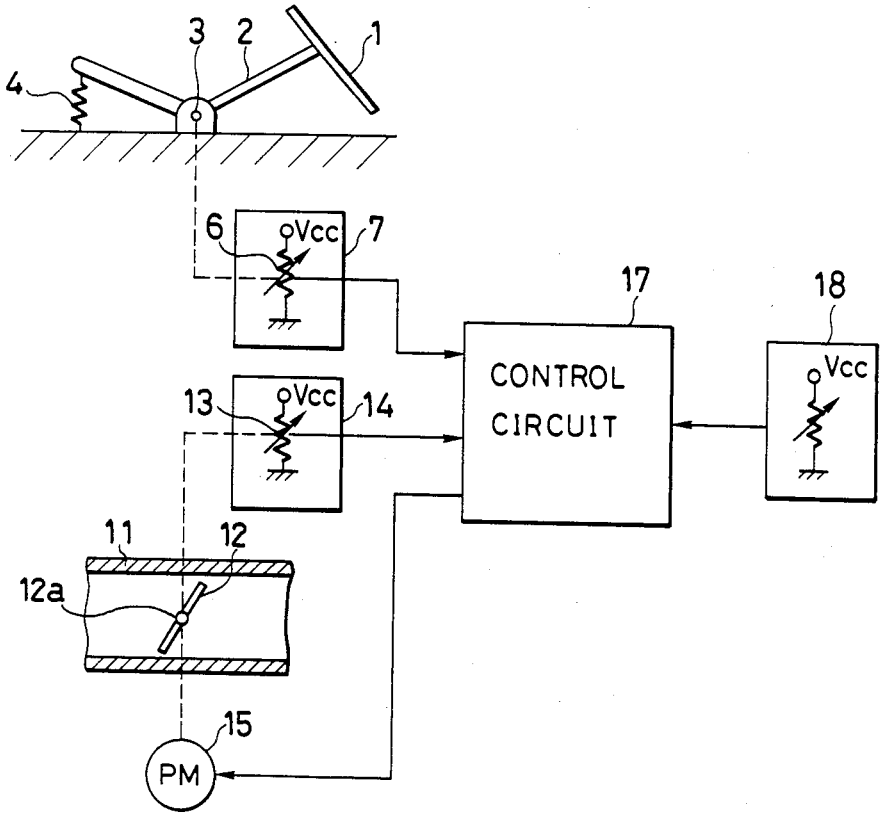
FIG. 1 is a general outline diagram of an embodiment of the present invention.

An embodiment of the present invention will be described, referring first to FIG. 1. In this embodiment, an accelerator pedal 1 is coupled to one end of an angle bracket 2 which is rotatably mounted on the floor of a vehicle by a shaft 3. A return spring 4 is coupled to the other end of bracket 2, and forces the accelerator pedal 1 upwards to an idling position. An accelerator actuation position sensor 7 consisting of a potentiometer 6 is coupled to the shaft 3, and produces an output voltage in accordance with the actuation position of the accelerator pedal 1, i.e. in accordance with the accelerator angle. This angle is defined as the angle through which the shaft 3 has rotated about the axis thereof, from the idling position of the accelerator pedal 1.

A throttle valve opening degree sensor 14 consists of a potentiometer 13 which is coupled to a shaft 12*a* of throttle valve 12, mounted in the engine intake pipe, and generates an output voltage in accordance with the degree of the opening of throttle valve 12. The shaft 12*a* is also coupled to the drive shaft of a pulse motor 15.

The sensors 7 and 14 and the motor 15 are connected to a control circuit 17, and the control circuit 17 is connected to a variable resistor 18. The variable resistor 18 is used to designate a throttle valve opening degree characteristic. A voltage $V_{cc}$ is applied across the fixed terminals of variable resistor 18, and a characteristic command output is produced as the voltage appearing on the slider terminal of variable resistor 18, and the voltage is supplied to control circuit 17.

Figure 2:
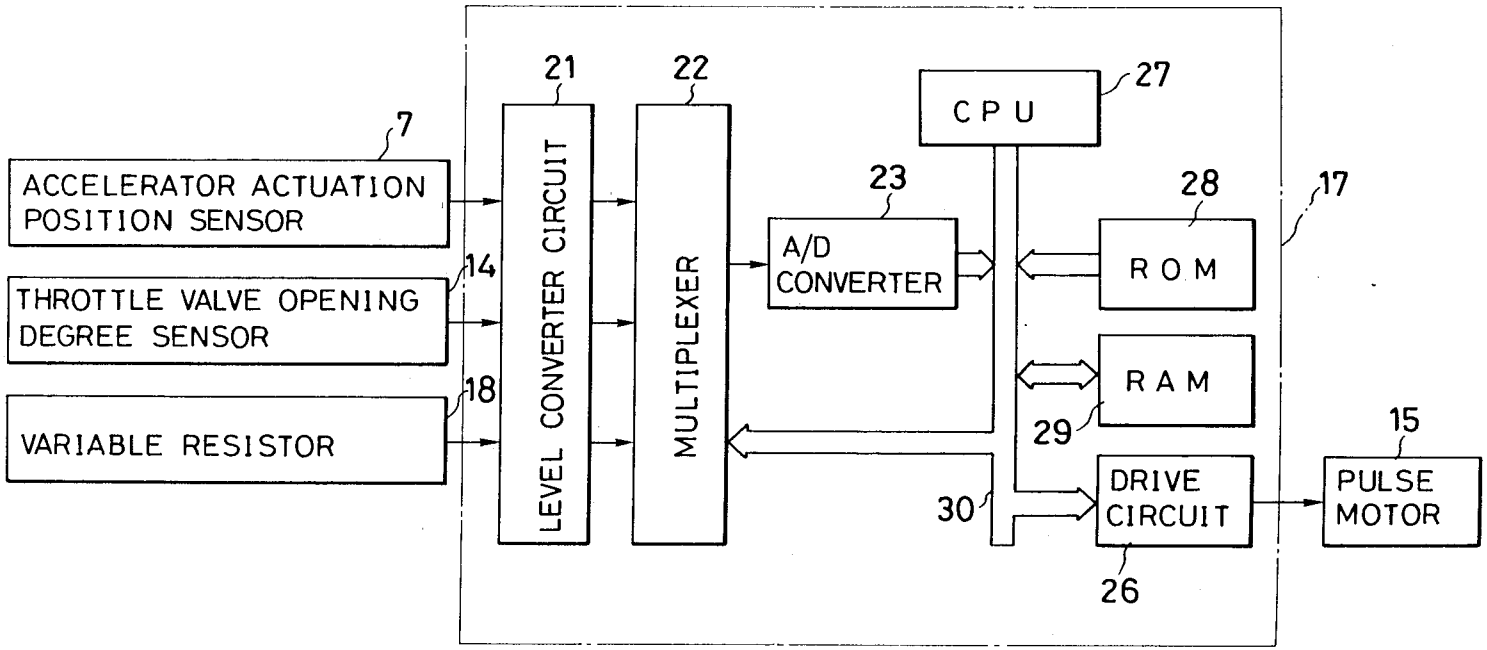
FIG. 2 shows a specific configuration for a control circuit in the embodiment of FIG. 1.

As shown in FIG. 2, the control circuit 17 contains a level converter circuit 21 which performs level conversions of the outputs from the accelerator actuation position sensor 7, the throttle valve opening degree sensor 14, and the variable resistor 18. The control circuit 17 also includes a multiplexer 22 which receives the level-converted output voltages from level converter circuit 21 and selects one of these outputs to be produced as an output, an A/D converter 23 which performs analog-digital conversion of the selected output voltage from multiplexer 22, a drive circuit 26 which drives the pulse motor 15, and a CPU (Central Processing Unit) 27 which performs digital operations in accordance with a program, a ROM (Read-only Memory) in which programs and data that have been written therein prior to operation of the apparatus of the invention are stored, and a RAM (Random Access Memory) 29. The multiplexer 22, A/D converter 23, drive circuit 26, CPU 27, ROM 28 and RAM 29 are mutually interconnected by a bus 30. Although not shown in the drawings, the CPU 27 receives clock pulses from a clock pulse generating circuit.

The operation of the embodiment is as follows. Respective data for an accelerator angle $\theta_{ACC}$, a throttle valve degree of opening $\theta_{th}$, and a throttle valve opening degree characteristic command supplied from A/D converter 23 are selectively transferred to the CPU 27 over the bus 30. The CPU 27 executes a read-in of the respective data in accordance with a processing program which is stored in ROM 28, with the read-in being performed in synchronism with the clock pulses. CPU 27 thereby performs processing as described hereinafter for generating commands which are supplied to the drive circuit 26 to drive the pulse motor 15. These commands consists of pulse motor valve-opening drive commands, pulse motor valve-closing drive commands, and pulse motor drive halt commands (whereby driving of pulse motor 15 is halted).

Figure 3:
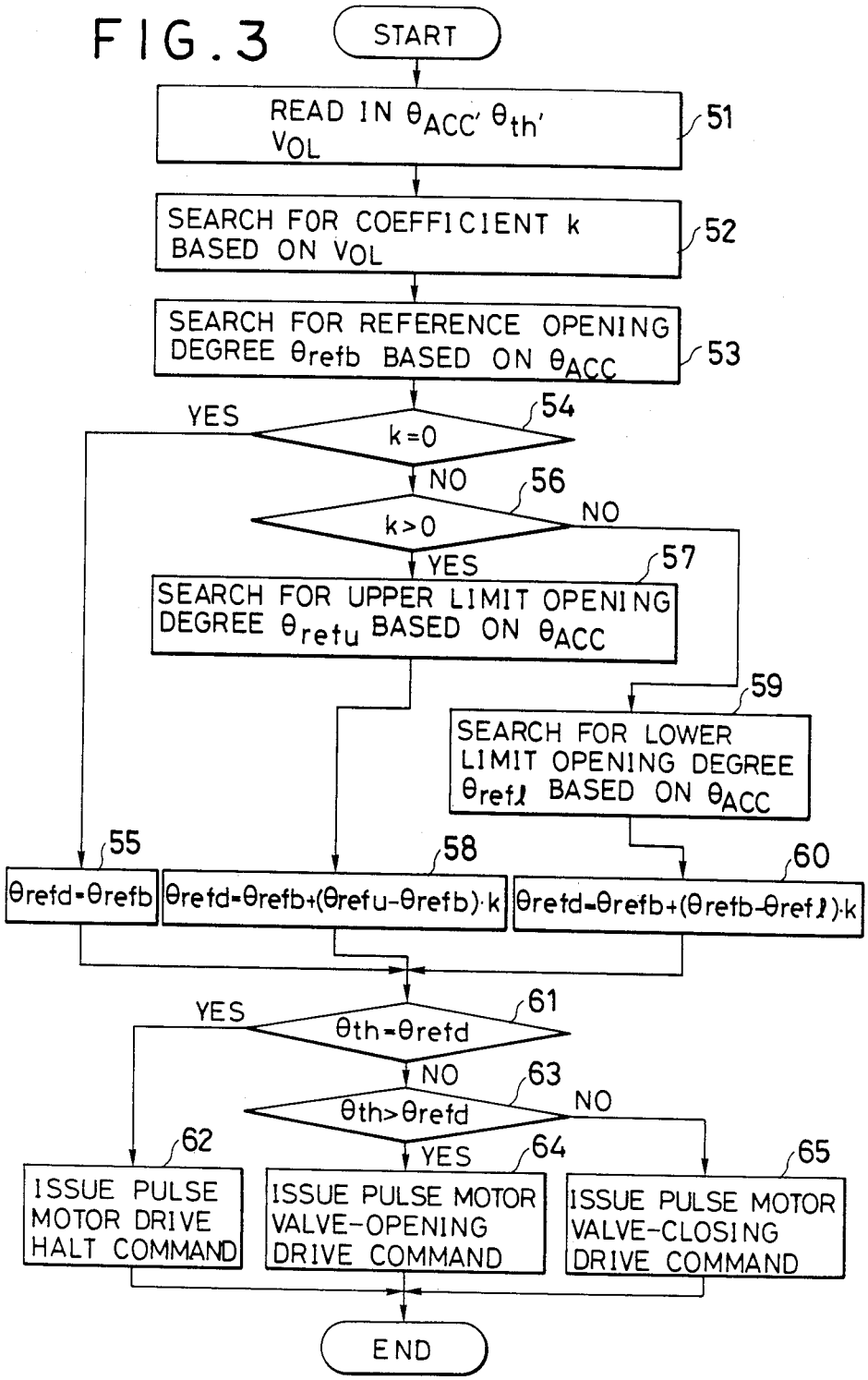
FIG. 3 is a flow chart for assistance in describing the operation of a CPU.
Figure 4:
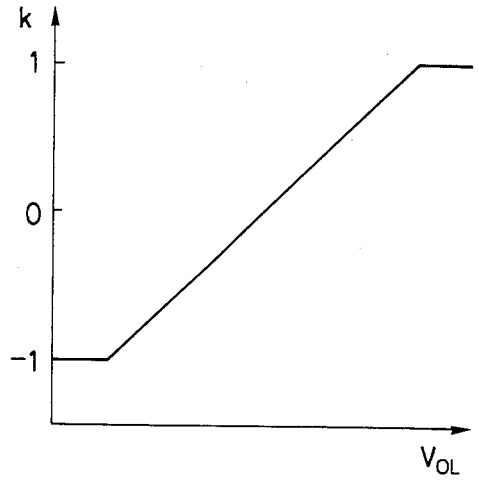
FIG. 4 shows the relationship between a characteristic command voltage $V_{OL}$ and a throttle valve coefficient k.

The operation of a throttle valve control apparatus according to the present invention will now be described with reference to the operating flow of CPU 27 which is shown in FIG. 3. At each of predetermined periodic interval, the CPU 27 first executes a read-in of the accelerator angle $\theta_{ACC}$, the throttle valve degree of the opening $\theta_{th}$, and the characteristic command voltage $V_{OL}$ (step 51). A search is then made for a throttle valve coefficient k in a k data map which has been stored beforehand in ROM 28 and corresponds to the characteristic shown in FIG. 4. The search is executed in accordance with the value of the characteristic command voltage $V_{OL}$ (step 52). A search is then made for a reference degree of the opening $\theta_{refb}$ in a $\theta_{refb}$ data map which has been stored beforehand in ROM 28 and corresponds to the reference opening degree characteristic represented by the full-line curve A shown in FIG. 5. This this search is executed in accordance with the accelerator angle $\theta_{ACC}$ (step 53). A decision is made as to whether or not the throttle valve coefficient k is zero (step 54). If $k=0$, then the value of the reference degree of the opening $\theta_{refb}$ which is found by this search is established as a target degree of the opening $\theta_{refd}$ (step 55). If $k\neq 0$, then a decision is made as to whether or not the throttle valve coefficient k is greater than zero (step 56). If $k>0$, then an upper limit degree of the opening $\theta_{refu}$ is searched for in a $\theta_{refu}$ data map has been stored beforehand in ROM 28 and which corresponds to the characteristics represented by the full-line curve B shown in FIG. 5. This data map search is executed in accordance with the accelerator angle $\theta_{ACC}$ (step 57). An interpolation computation of the target degree of the opening $\theta_{refd}$ is then performed using the following equation (step 58):

$$\theta_{refd}=\theta_{refb}+(\theta_{refu}-\theta_{refb})\cdot k\,.$$

Figure 5:
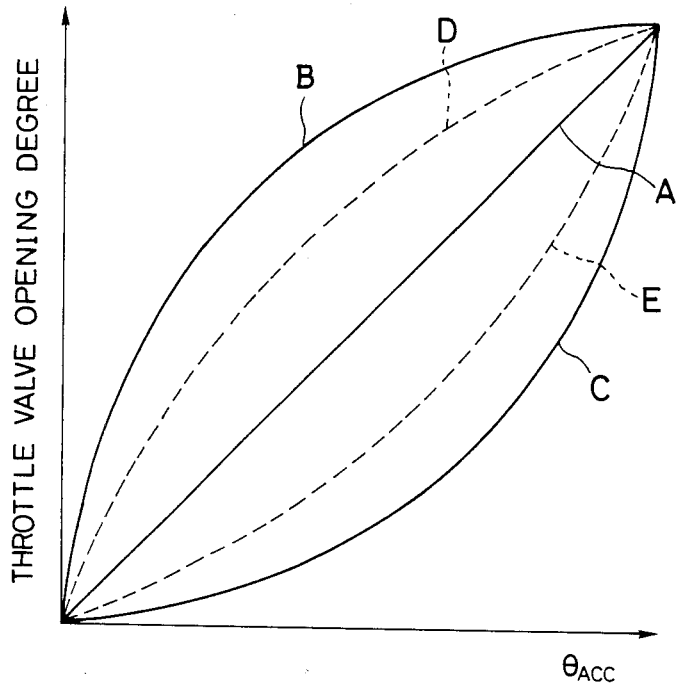
FIG. 5 is a graph showing relationships between the accelerator angle $\theta_{ACC}$ and the throttle valve opening degree characteristics.

If k is found to be less than zero, then a lower limit degree of the opening $\theta_{refl}$ is searched for in a $\theta_{refl}$ data map which has been stored beforehand in ROM 28 and corresponds to the characteristics represented by the full-line curve C shown in FIG. 5. This data map search is executed in accordance with the accelerator angle $\theta_{ACC}$(step 59). An interpolation computation of the target degree of opening $\theta_{refd}$ is then performed using the following equation (step 60):

$$\theta_{refd}=\theta_{refb}+(\theta_{refb}-\theta_{refl})\cdot k$$

In this way, the target degree of the opening $\theta_{refd}$ is obtained from step 55, 58 or 60, whereupon a decision is made as to whether or not the throttle valve degree of the opening $\theta_{th}$ which has been read in is identical to the target degree of the opening $\theta_{refd}$ (step 61). If $\theta_{th}=\theta_{refd}$, then a pulse motor drive halt command is generated and is issued to the drive circuit 26 (step 62). If $\theta_{th}\neq\theta_{refd}$, then a decision is made as to whether or not $\theta_{th}$ is greater than $\theta_{refd}$ (step 63). If $\theta_{th}>\theta_{refd}$, then a pulse motor valve-closing drive command is issued to drive circuit 26, whereby the throttle valve is driven in the closing direction (step 64). If $\theta_{th}$ is not found to be greater than $\theta_{refd}$, and hence is less than $\theta_{refd}$, then a pulse motor valve-opening drive command is issued to drive circuit 26, whereby the throttle valve is driven in the opening direction (step 65).

The drive circuit 26 responds to a pulse motor valve-opening drive command by rotating the pulse motor 15 in the forward direction to thereby drive the throttle valve 12 towards the valve closed condition. The drive circuit 26 responds to a pulse motor valve-closing drive command by rotating the pulse motor 15 in the forward direction to thereby drive the throttle valve 12 towards the valve open condition. Moreover, drive circuit 26 responds to a pulse motor drive halt command by halting the rotation of pulse motor 15, to thereby maintain the current degree of the throttle valve opening.

In this way, if the throttle valve coefficient k is zero, the reference degree of the opening $\theta_{refb}$characteristic (shown by the full-line curve A in FIG. 5) is used as the throttle valve opening degree characteristic, and the degree of the throttle valve opening $\theta_{refd}$ is obtained from that characteristic in accordance with the accelerator angle $\theta_{ACC}$. If on the other hand $k>0$, then the throttle valve degree of opening $\theta_{refd}$ is obtained in accordance with $\theta_{ACC}$ from a throttle valve opening degree characteristic which is intermediate between the reference degree of the opening $\theta_{refd}$characteristic and the upper limit degree of the opening $\theta_{refu}$characteristic (indicated by the full-line curve B in FIG. 5), for example the characteristic indicated by broken-line curve D in FIG. 5. As the value of the throttle valve coefficient k becomes higher, the intermediate characteristic will approach the upper limit $\theta_{refu}$ characteristic. If $k<0$, then the throttle valve degree of the opening $\theta_{refd}$ is obtained in accordance with $\theta_{ACC}$ from a throttle valve opening degree characteristic which is intermediate between the reference degree of the opening $\theta_{refd}$ characteristic and the lower limit degree of the opening $\theta_{refl}$ characteristic (indicated by the full-line curve C in FIG. 5), for example the characteristic indicated by broken-line curve E in FIG. 5.

In the embodiment of the present invention described above, a search is made for the throttle valve coefficient k in step 52 each time the program is executed. However it would be equally possible to read in the characteristic command voltage $V_{OL}$ only once, search for the corresponding value of throttle valve coefficient k, and to thereafter use the value of k thus obtained until a change occurs in the characteristic command voltage $V_{OL}$.

Furthermore, in the embodiment of the present invention described above, a variable resistor is used as the means for generating characteristic commands, whereby commands can be generated in a continuously variable manner to obtain the appropriate throttle valve degree of the opening characteristics. However, it would be equally possible to utilize a switch to generate commands to designate a different throttle valve degree of the opening characteristics, in a stepwise-varying manner.

With a throttle valve control apparatus according to the present invention as described above, a reference throttle valve degree of the opening is set which is determined by the relationship between the accelerator pedal actuation position and a reference opening degree characteristic. A boundary throttle valve degree of the opening is set which is determined by the relationship between the accelerator pedal actuation position and at least one upper limit opening degree characteristic and a lower limit opening degree characteristic. A target degree of the opening is then computed by interpolation based on the relationship between the reference degree of the opening and the boundary degree of the opening, in conjunction with the contents of a characteristic command. In this way, such a controller can meet the requirements of slightly different driving operations of various drivers by deriving a large number of throttle valve opening degree characteristics, without the necessity for employing a large number of memory elements to store such characteristics. Thus, such a controller is convenient and cost-effective, since a large amount of memory capacity is unnecessary.

What is claimed is:

1. A throttle valve control apparatus for controlling a degree of opening of a throttle valve disposed in an intake system of an internal combustion engine, comprising:

accelerator actuation detection means for producing an output in accordance with an actuation position of an accelerator pedal, setting means for setting a target degree of opening of the throttle valve in accordance with the actuation position of the accelerator pedal detected by the accelerator actuation detection means, throttle valve opening degree detection means for producing an output in accordance with an actual degree of opening of the throttle valve, drive means for driving the throttle valve in a direction such as to reduce an amount of deviation between the actual degree of opening of the throttle valve as detected by the throttle valve opening degree detection means and the target degree of opening, and command means for issuing a characteristic command to specify a requisite target opening degree characteristic;

wherein said setting means sets a reference degree of opening of the throttle valve in accordance with the actuation position of the accelerator pedal by utilizing a reference opening degree characteristic and sets a boundary degree of opening of the throttle valve in accordance with the actuation position of the accelerator pedal by utilizing at least one of an upper limit opening degree and a lower limit opening degree of the throttle valve; and wherein the target degree of opening is computed from a relationship between the reference degree of opening and the boundary degree of opening which have thus been respectively set by said setting means, in conjunction with the contents of the characteristic command.

2. A throttle valve control apparatus according to claim 1, wherein the setting means sets throttle valve coefficient in accordance with the contents of the characteristic command, and wherein a value obtained by multiplying the difference between the reference degree of opening and the boundary degree of opening by the throttle valve coefficient is employed to compute the target degree of opening.

3. A throttle valve control apparatus according to claim 1, in which the command means comprises a switch.

4. A throttle valve control apparatus according to claim 1, in which the command means comprises a variable resistor.

* * * * *